US009226527B2

(12) United States Patent
Dahlgren et al.

(10) Patent No.: US 9,226,527 B2
(45) Date of Patent: Jan. 5, 2016

(54) SOCK

(71) Applicants: Peter D. Dahlgren, Santa Ana, CA (US); Donald R. Dahlgren, Santa Ana, CA (US)

(72) Inventors: Peter D. Dahlgren, Santa Ana, CA (US); Donald R. Dahlgren, Santa Ana, CA (US)

( * ) Notice: Subject to any disclaimer, the term of this patent is extended or adjusted under 35 U.S.C. 154(b) by 274 days.

(21) Appl. No.: 13/987,606

(22) Filed: Aug. 13, 2013

(65) Prior Publication Data

US 2015/0047103 A1 Feb. 19, 2015

(51) Int. Cl.
*A41B 11/02* (2006.01)

(52) U.S. Cl.
CPC ..... *A41B 11/02* (2013.01); *A41B 2400/60* (2013.01)

(58) Field of Classification Search
CPC ..... A41B 11/004; A41B 11/005; A41B 11/01
USPC ..... 2/239; 66/169 R, 170, 171, 178 R, 66/182–189, 191, 194, 198, 199, 200, 202
See application file for complete search history.

(56) References Cited

U.S. PATENT DOCUMENTS

| | | | | |
|---|---|---|---|---|
| 4,898,007 | A | 2/1990 | Dahlgren | |
| 5,095,548 | A | 3/1992 | Chesebro, Jr. | |
| 5,307,522 | A * | 5/1994 | Throneburg et al. | 2/239 |
| 5,319,807 | A * | 6/1994 | Brier | 2/239 |
| 5,353,524 | A | 10/1994 | Brier | |
| 5,708,985 | A * | 1/1998 | Ogden | 2/239 |
| 6,016,575 | A | 1/2000 | Prychak | |
| 6,286,151 | B1 | 9/2001 | Lambertz | |
| 6,341,505 | B1 * | 1/2002 | Dahlgren | 66/185 |
| 6,547,751 | B1 | 4/2003 | Barberio | |
| 6,708,348 | B1 | 3/2004 | Romay | |
| 7,069,600 | B1 | 7/2006 | Romay | |
| 7,552,603 | B2 | 6/2009 | Dahlgren | |
| 7,614,257 | B2 | 11/2009 | Araki | |
| 7,681,254 | B2 | 3/2010 | Lambertz | |
| 8,146,266 | B2 | 4/2012 | Vattes | |
| 2006/0143801 | A1 | 7/2006 | Lambertz | |
| 2009/0000339 | A1 | 1/2009 | Dahlgren | |
| 2009/0158504 | A1 | 6/2009 | Sparrow | |
| 2011/0035863 | A1 | 2/2011 | Lambertz | |
| 2011/0099680 | A1 | 5/2011 | Gordon | |
| 2011/0277218 | A1 | 11/2011 | Padilla | |
| 2014/0157491 | A1 * | 6/2014 | Dahlgren | 2/239 |
| 2015/0033447 | A1 * | 2/2015 | Riaz | 2/239 |
| 2015/0047103 | A1 * | 2/2015 | Dahlgren et al. | 2/239 |

FOREIGN PATENT DOCUMENTS

EP 0626140 A1 11/1994

* cited by examiner

*Primary Examiner* — Gloria Hale

(57) ABSTRACT

Socks with ribs, channels and padding positioned to facilitate moisture movement from the interior of the sock upwardly and outwardly from a shoe or boot to aid in maintaining a dry condition for a sock and footwear. The sock heel may have an ankle open end that is connected to a leg portion. The tubular portion of the sock has multiple tube ribs transversally positioned and longitudinally spaced apart to form multiple tube channels wherein the tube ribs are formed by at least one additional yarn of material extending from an inner surface of the tubular portion. A portion of the multiple tube ribs are curved from a straight line on at least a portion of the inner surface to extend upwardly into the instep portion and may curve towards the heel portion. The toe portion of the sock may have toe ribs extending upwardly toward the instep portion.

20 Claims, 4 Drawing Sheets

SOCK

BACKGROUND OF THE INVENTION

This invention relates to human footwear and more particularly to socks. The socks have ribs, channels and padding positioned on the inner surface of the sock to facilitate movement of moisture from the interior of the sock upwardly and outwardly from a shoe, boot or like footwear to aid in maintaining a dry condition in the footwear of users.

Socks may be known that use or employ materials such as woven or knit yarn that is absorbent and may facilitate wicking action or that is nonabsorbent and may be a barrier to moisture. The structure of the use of such materials hydrophilic and hydrophobic, in a sock is important to maintaining a proper moisture-dryness condition for a user of socks and footgear, such as, shoes, boots and the like. Socks with zones or areas of absorbent and nonabsorbent material to create conditions in clothing or socks may be known. Also socks with rib structures may be known for moisture control. Rib structures may also be known for frictional engagement with the foot or shoe of a user. However, it is believed there is not a sock structure of ribs, channels and pads that use hydrophilic, hydrophobic and combinations of these materials to move moisture in a sock effectively out of footwear for evaporation. There is a need for a sock with an interior structure positionable against a user's foot to move or urge vapor or moisture that is normally sweat away from the toe, heal and sole of a foot toward the side and upper portion or instep of a foot to exit footwear for evaporation.

SUMMARY OF THE INVENTION

The present invention is directed to garments or socks that with ribs, channels and padding positioned to facilitate moisture movement from the interior of the sock upwardly and outwardly from a shoe or boot to aid in maintaining a dry condition for a sock and footwear of a user. A sock may have a foot portion with a toe at one end and a heel at the other end with a tubular portion connected between the toe and heel. The heel may have an ankle open end that is connected to a leg portion of the sock. The tubular portion has multiple tube ribs transversally positioned and longitudinally spaced apart to form multiple tube channels wherein the tube ribs are formed by at least one additional yarn of material extending from an inner surface of the tubular portion to position the tube ribs to contact a foot inserted in the sock. A portion of the multiple tube ribs are curved from a straight line on at least a portion of the inner surface to extend upwardly in a direction toward the heel from the sole portion of the tubular portion to the instep portion.

The toe portion of the sock on the sole portion may also have toe ribs that extend upwardly toward the instep portion of the tubular member. The heel may have a heel pad with heel ribs extending upwardly and spaced apart to engage leg ribs in the leg portion of the sock to facilitate movement of moisture upward to exit footwear such as a boot to facilitate moisture evaporation.

These and other features, aspects and advantages of the present invention will become better understood with reference to the following drawings, description and claims.

DETAILED DESCRIPTION

Figure 1:
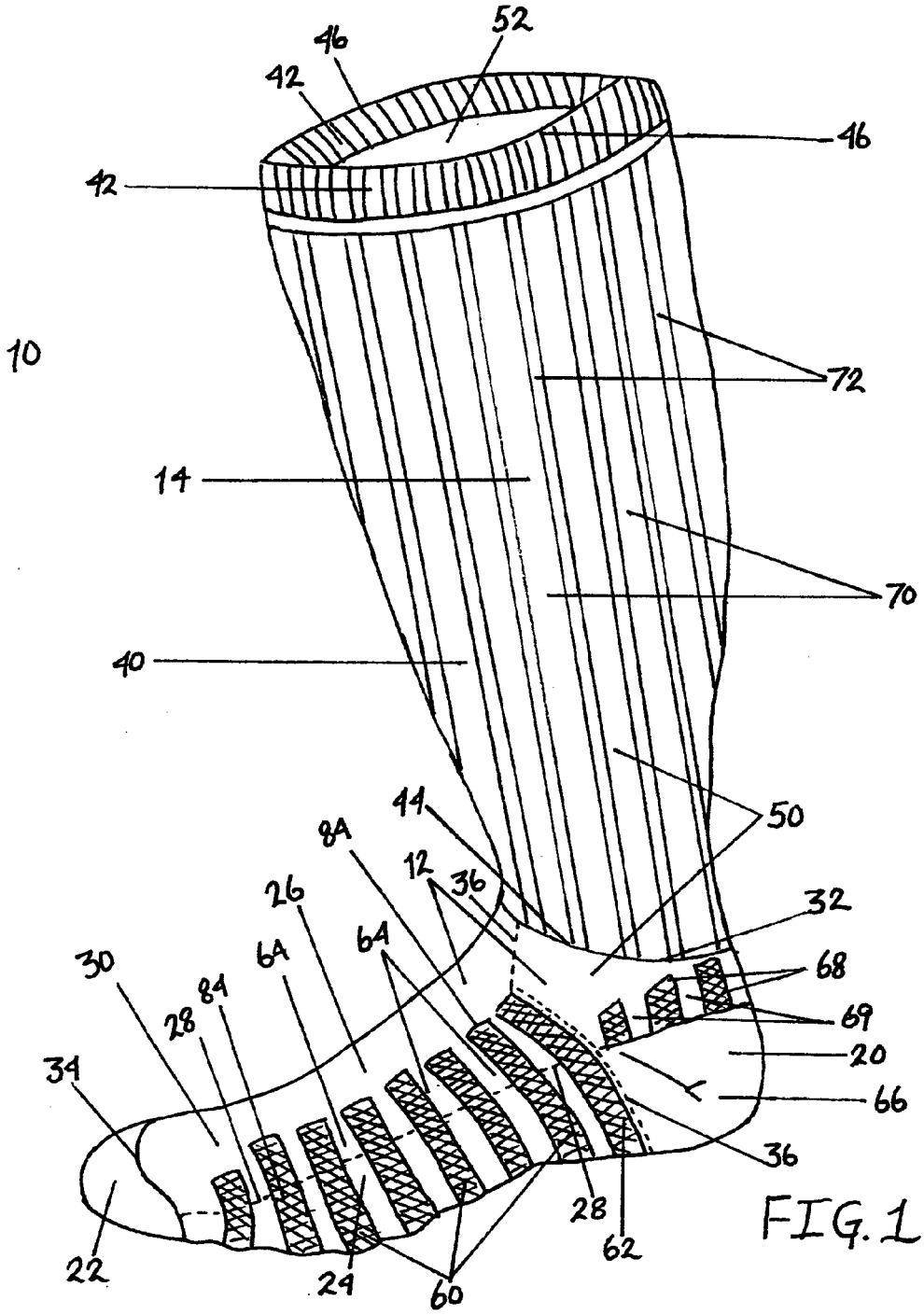
FIG. 1 illustrates a perspective side elevation view of a sock according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 4, a sock 10 has a foot portion 12 and a leg portion 14. The foot portion 12 has a heel 20 at one end that may be a heel pocket and a toe that may be a toe box at the opposite end. Extending between the heel 20 and toe 22 is a sole portion 24 and an instep portion 26 that are joined together along longitudinal edges 28 or the sole 24 and instep 26 portions may be formed as a tube 30 all to form a complete foot portion 12 of the sock 10.

The sock may be pieced or integrally knitted.

The leg portion 14 has an ankle and lower leg portion 40 and may have an upper band portion 42. The leg portion 14 is joined at a lower edge 44 to an ankle opening edge 32 of the foot portion 12. The term longitudinal refers to the direction or axis of the sock 10 from the toe 22 to the band portion 42. The term transverse refers to the direction orthogonal or perpendicular to the longitudinal axis.

Referring to FIG. 1, the sock 10 is illustrated in an inside out configuration with the inner surface 50 of the sock 10 exposed or visible and the outer surface 52 other than a portion at the upper band portion 42 not visible. The tube 30 portion of the foot portion 12 may have one or more tube ribs 60 of raised material formed on the inner surface 50. The tube ribs 60 are curved from a straight line on at least a portion of the inner surface 50 to deviate in a direction toward the heel 20 of the foot portion 12 as the tube ribs 60 traverse upwardly from the sole portion 24 toward the instep portion 26 of the foot portion 12. A heel edge rib 62 that is formed of hydrophilic yarn may be curved along the edge 34 where the heel 20 joins with the tube 30 to wick moisture upwardly toward the instep portion 26. The ribs 60, 62 may be a raised cushion yarn type construction, for example, Terry cloth, with a height above the inner surface 50 sufficient to create channels 64 to allow air circulation to carry moisture or sweat as a vapor or fluid from the relatively lower portion of a user's foot toward the upper portion or instep of the foot.

The heel pocket 20 of the foot portion 12 may have a hydrophilic heel pad 66 of yarn material with at least one heel rib 68 extending generally vertically from the heel pad 66 on the inner surface 50 to end adjacent the ankle opening edge 32. The instep portion 26 of the foot portion 12 may have a hydrophilic woven yarn construction to wick moisture toward the ankle opening edge 32. With the rearward biased curve of the ribs and the wicking structure of the instep portion 26 it has been found that with a user's action of walking or running, the motion and foot flexure inside a shoe or boot causes moisture to progress upwardly and rearwardly in the user's sock 10.

The toe box 22 of the foot portion 12 may be formed as a toe pad 78 of hydrophilic material to wick moisture toward the tube 30 under motion and pressure of a user's foot during walking and running to urge moisture through the sock 10 to remove moisture out of a shoe or boot. The toe box 22 may have one or more toe ribs 74 to form toe channels 76 to channel moisture toward the tube 30.

The leg portion 14 of the sock 10 may have leg ribs 70 that are a raised material formed on the inner surface 50 and that extend in the longitudinal direction of the leg portion 14 to be positioned generally vertically when worn by a user. The leg ribs 70 may be formed of a hydrophilic yarn material of a structure raised above the inner surface 50 with the leg ribs 70 spaced apart to form leg channels 72 in the leg portion 14. The leg channels 72 may allow air movement to carry moisture or sweat as vapor or fluid from the ankle opening edge 32 to the upper edge 46 of the sock 10. There may be an upper band portion 42 formed at the end of the leg portion 14 that may have leg ribs 70 and leg channels 72. The leg ribs 70 may be formed of a hydrophilic or hydrophobic yarn or a combination of both materials. If hydrophilic yarn, it may aid in moving moisture upwardly and out of a shoe or boot worn by the user. Once moisture is moved out of a shoe or boot it can more easily evaporate thereby aiding in maintaining a dry condition environment for a user.

Figure 2:
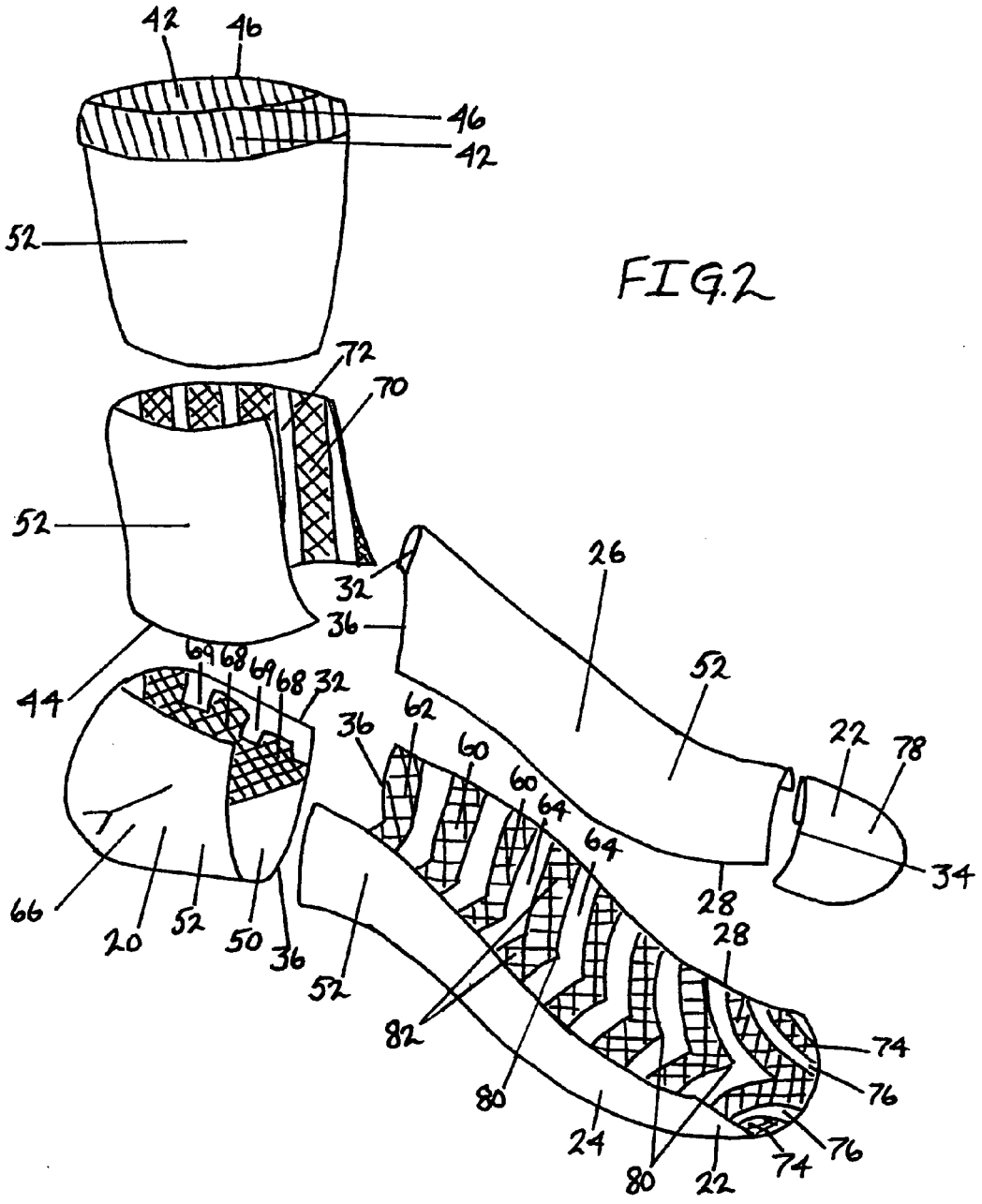
FIG. 2 illustrates a an exploded perspective side elevation view of a sock according to an embodiment of the invention.
Figure 3:
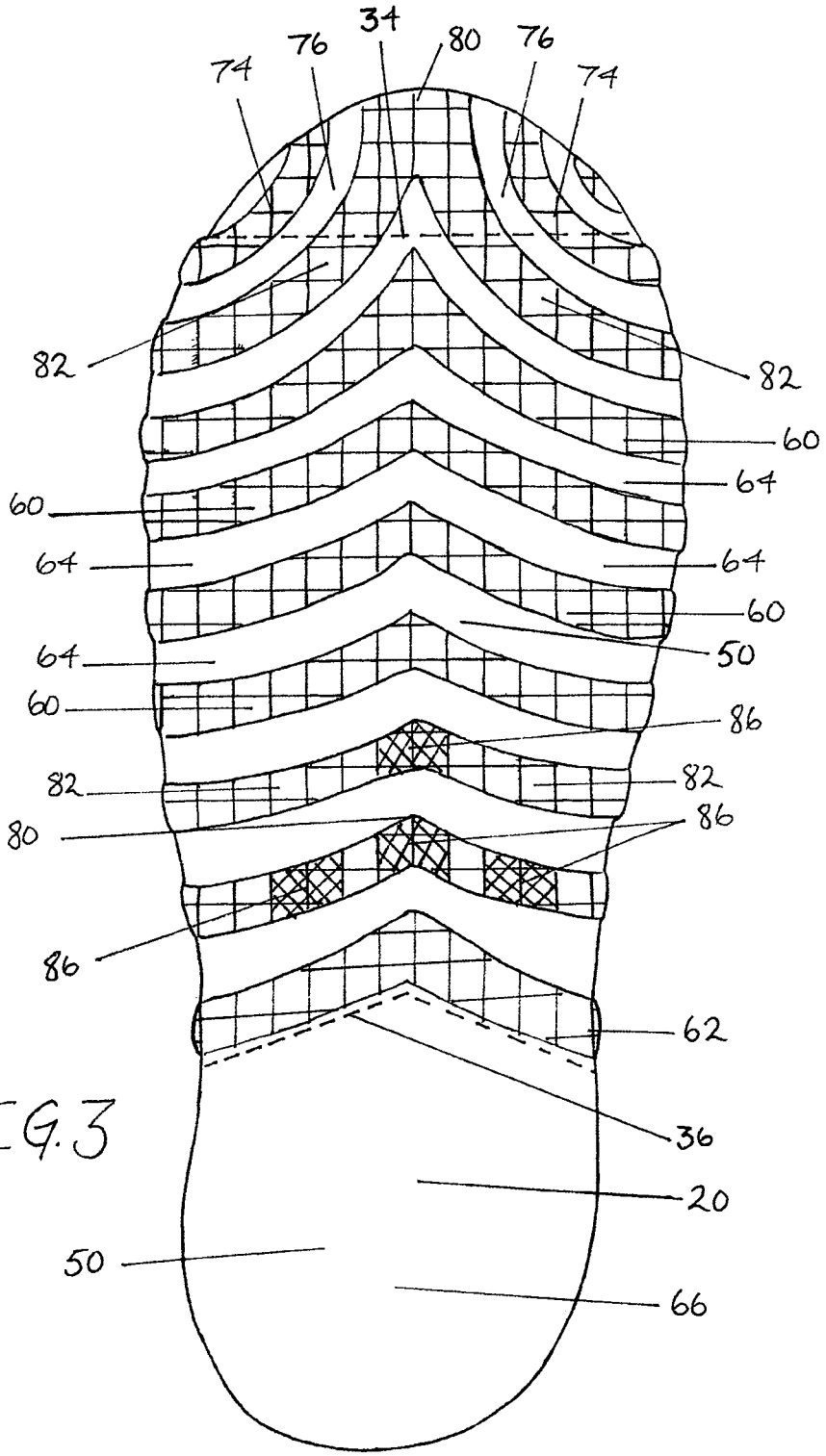
FIG. 3 illustrates a bottom sole inner surface view of a sock according to an embodiment of the invention.
Figure 4:
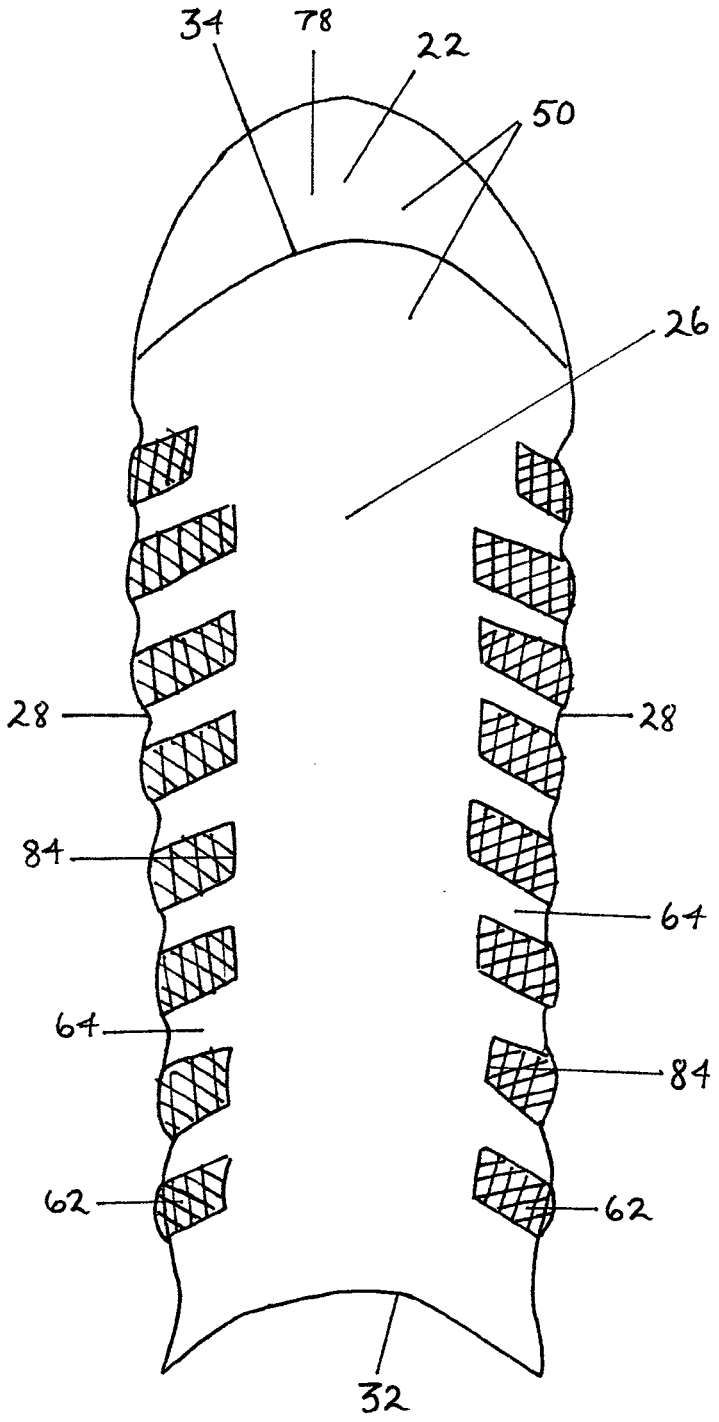
FIG. 4 illustrates a top instep inner surface view of a foot portion without a heel of a sock according to an embodiment of the invention.

Referring to FIGS. 1 through 4, an example of the shape or form of the rib and channel structure relative to the inner surface 50 of a sock 10 are illustrated. In FIGS. 2 and 3 the tube ribs 60 are formed with an intersection point 80 or vertex for two rib members 82 that curve rearward toward the heel 20. The rib end portions 84 in the instep portion 26 of the tube 30, reference longitudinal line 28, are generally inclined toward the heel 20, but those rib end portions 84 adjacent to the heel may curve toward the toe 22 because of the shape of a sock 10 when worn on a user. See for example the rib end portions 84 of the heel edge rib 62 in FIG. 1. The rib end portion 84 of ribs such as the heel edge rib 62 may be eliminated from the rib structure of a sock 10 to facilitate moisture movement toward ankle opening edge 32.

The rearward curved or angled orientation of the tube ribs 60 as the tube ribs progress upward toward the instep portion 26 aid in moisture movement upward toward the instep portion 26 that may be a material to facilitate movement or wicking of moisture toward the ankle opening edge 32 of the tube 30. While the tube ribs 60 are illustrated with an angular vertex 80, a smooth curved apex transition between the two rib members 82 may also be used. The intersection point 80 may also have an opening or less dense portion 86 as illustrated in FIG. 3 for one or more of the tube ribs 60 to allow moisture flow directly rearward toward the heel 20. This may allow generally trapped moisture to move rearwardly and eventually upwardly to exit the shoe or boot of a user.

Any channel, vent, or passageway may be made up of two or more elevations that have any degree of curvature and or angle other than a straight line, running inside of the bottom of the sock, up the sides and to the top or instep continuously. These channels or ribs may have a bias toward the sock heel. These channels can be knit using hydrophobic or hydrophilic yarns or any percentage combination of both. Because of the inherent shape of the channels, air carrying sweat vapor is forced through the channels with every step by a user. Although a "V" shape channel design is illustrated, the structure will essentially work with channels of multiple height with any degree of curvature and or angle that have a constant flow. The channels start at the bottom of the sock starting at the toe box continuing to the heel cup. They generally flow up the sides of the foot and to the top instep area of the sock. All channels and elevations are knit on the inside of the sock, thus creating a space between the foot and the sock allowing air to flow through and facilitate the evaporation process. These channels allow for unrestricted airflow without blockage by nature of design from the inside bottom of the sock, up the sides and to the top instep. Once the air carrying sweat vapor flows through the channel to the top instep of the sock, the evaporation process can be better facilitated and expedited. Ultimately this allows for a drier, more comfortable foot.

While the various ribs 60, 62, 68, 70 have been described in general or in certain instances as being hydrophilic yarn material, it will be understood that as long as the various ribs are structured to create channels to facilitate the movement of moisture away from the bottom of a user's foot toward the instep or leg in order to move moisture outwardly from a shoe, boot or the like, the various ribs may be formed of hydrophilic or hydrophobic yarn or a combination of both material. Where in the structure of the sock 10 a wicking action is desired, for example, a toe pad 78, a heel pad 66 or a rib such as a heel edge rib 62, then a material structure with hydrophilic characteristics may be used. Where water barrier characteristic material may be desired, for example in the bottom of a heel pocket 20, to inhibit collection of moisture from a user's foot, a material structure with hydrophobic characteristics may be used.

While the invention has been particularly shown and described with respect to the illustrated embodiments thereof, it will be understood by those skilled in the art that the foregoing and other changes in form and details may be made therein without departing from the spirit and scope of the invention.

We claim:

1. A sock, comprising:

a foot portion with a toe box at one end and a heel at an opposite end, a sole portion and an instep portion joined together along a longitudinal separation line to form a tube that is connected to said toe box along a toe separation line and to said heel along a heel separation line;

said heel has an ankle open end;

said toe box, said heel and said tube formed of a knitted yarn material to define an inner surface and an outer surface;

said tube has a plurality of tube ribs longitudinally spaced apart to form a plurality of tube channels wherein said plurality of tube ribs are formed by at least one additional layer of yarn material extending from said inner surface of said tube to position said tube ribs to contact a foot inserted in said sock; and wherein a portion of said plurality of tube ribs are at least one of angularly curved and/or angled from a straight line on at least a portion of said inner surface of said sole portion to extend upwardly in a direction toward said heel from said sole portion toward said instep portion.

2. The sock as in claim 1 wherein at least one of said plurality of tube ribs terminates with a rib end portion in said instep portion.

3. The sock as in claim 1 wherein at least one of said plurality of tube ribs is a heel edge rib extending upwardly adjacent said heel separation line.

4. The sock as in claim 1 wherein said plurality of tube ribs are formed as two rib members joined at an intersection point positioned at an approximate transverse center at a bottom of said sole portion.

5. The sock as in claim 1 wherein said plurality of tube ribs are formed of a material selected from one of a hydrophilic, hydrophobic, and combination of hydrophilic and hydrophobic yarn material.

6. The sock as in claim 1 wherein said foot portion knitted material to form said inner surface and said outer surface has said instep portion formed from a hydrophilic yarn material.

7. The sock as in claim 1 wherein said heel is a heel pocket and a bottom portion has a heel pad of hydrophilic yarn material.

8. The sock as in claim 7 wherein a plurality of heel ribs extend upwardly from said heel pad to an ankle opening edge of said heel pocket.

9. The sock as in claim 1 wherein said toe box has at least one toe rib formed in a sole portion that is at least one of angularly curved and/or angled from a straight line on at least a portion of said inner surface to extend upwardly in a direction toward said heel from said toe portion toward said instep portion.

10. The sock as in claim 9 wherein a toe pad of hydrophilic yarn material is formed on the instep portion of said toe box.

11. The sock as in claim 1 further comprising:

a leg portion is attached at a lower edge to said ankle open end at an ankle opening edge; and said leg portion has a plurality of leg ribs longitudinally spaced apart to from a plurality of leg channels wherein said plurality of leg ribs are formed by at least one additional layer of yarn material extending from said lower edge to an upper edge of said leg portion.

12. The sock as in claim 11 wherein said leg portion has an upper band portion of yarn material formed annularly around said leg portion inner surface adjacent said upper edge.

13. The sock as in claim 12 wherein said leg ribs extend onto said upper band potion.

14. The sock as in claim 11 wherein said plurality of tube ribs are formed of a material selected from one of a hydrophilic, hydrophobic, and a combination of hydrophilic and hydrophobic yarn material.

15. An integrally knitted sock with wicking abilities to wick moisture upwardly and away from a sock sole portion, comprising:

an integrally knitted foot portion having a toe box at one end and a heel portion at an opposite end;

a sole portion and an instep portion integrally joined to form a tube portion that is integrally knitted to said toe box and said heel portion;

said heel portion has an ankle open end;

said toe box, said heel portion and said tube are all integrally formed of a knitted material to define an inner surface and an outer surface;

said tube has a plurality of tube ribs longitudinally spaced apart to form a plurality of tube channels wherein said plurality of tube ribs are formed at least of one additional layer of yarn material extending from said inner surface of said tube at said sole portion to position said tube ribs and that are configured to contact a wearer's foot inserted in said sock;

and wherein a portion of said plurality of tube ribs are angularly curved and/or angled from a straight line on at least a portion of said inner surface of said sole portion to extend upwardly in a direction toward said heel portion from said sole portion and toward said instep portion.

16. The sock as claimed in claim 15 wherein at least one of said plurality of tube ribs terminates with a rib end portion in said instep portion.

17. The sock as claimed in claim 15 wherein said at least one of said plurality of said tube ribs are formed as two rib members joined at an intersection point positioned at an approximate transverse center at a bottom of said sole portion and which then extend in an angularly curved or angularly straight line upwardly in a direction toward said heel from said sole portion and toward said instep portion.

18. The sock as claimed in claim 15 wherein said plurality of said tube ribs are formed of a material selected from one of a hydrophilic, hydrophobic and combination of a hydrophilic and hydrophobic material.

19. The sock as claimed in claim 15 wherein a leg portion is integrally knitted at a lower edge to said ankle open end at an ankle opening; and said leg portion has a plurality of leg ribs longitudinally spaced apart to form a plurality of leg channels wherein said plurality of leg ribs are formed by at least one additional layer of yarn material extending from said lower edge to an upper edge of said leg portion.

20. The sock as claimed in claim 19 wherein said plurality of said tube ribs are formed of a material selected from one of a hydrophilic, hydrophobic and a combination of hydrophilic and hydrophobic yarn material; wherein said foot portion instep portion is formed of a hydrophilic yarn material and wherein said heel portion is a heel pocket with a bottom portion having a heel pad of a hydrophilic yarn material; wherein a plurality of heel ribs extend upwardly from said heel pad to an ankle opening edge of said heel pocket; wherein said toe box has at least one toe rib formed in a sole portion that is angularly curved, curved and/or angled from a straight line on at least a portion of said inner surface to extend upwardly in a direction toward said heel from said toe portion toward said instep portion; and wherein a toe pad of hydrophilic yarn material is formed on the instep portion of said toe box.

* * * * *